United States Patent [19]

Summers

[11] 4,236,771

[45] Dec. 2, 1980

[54] PORTABLE DISPOSABLE BASIN APPARATUS

[76] Inventor: Geraldine Y. Summers, 721 - 22nd St., Newport News, Va. 23607

[21] Appl. No.: 3,398

[22] Filed: Jan. 12, 1979

[51] Int. Cl.[3] ..... A47B 77/06; A47K 1/04; A47F 3/14

[52] U.S. Cl. ..... 312/228; 312/205; 312/250; 248/149; 211/132; 108/124; 4/167

[58] Field of Search ..... 312/228, 258, 205, 250; 211/132; 108/124; 4/167; 248/129, 149

[56] References Cited

U.S. PATENT DOCUMENTS

| | | | |
|---|---|---|---|
| 1,264,105 | 4/1918 | McGlauflin | 312/255 |
| 1,300,533 | 4/1919 | Wessinger | 248/149 |
| 1,334,260 | 3/1920 | Quick | 4/167 |
| 2,157,786 | 5/1939 | Coordes | 312/228 |
| 2,384,112 | 9/1945 | Meyer | 248/146 |
| 2,490,588 | 12/1949 | Frie et al. | 312/250 |
| 2,524,873 | 10/1950 | Baxter | 211/132 |
| 2,644,590 | 7/1953 | Baxter | 211/132 |
| 2,720,437 | 10/1955 | Baxter | 211/132 |
| 2,859,082 | 11/1958 | Logue | 312/228 |
| 3,221,677 | 12/1965 | Kerr | 312/205 |
| 3,401,653 | 9/1968 | Knoblock | 108/124 |
| 3,627,396 | 12/1971 | Miller | 312/228 |
| 3,983,583 | 10/1976 | Herman et al. | 312/228 |
| 4,024,590 | 5/1977 | Wendt | 4/167 |
| 4,065,195 | 12/1977 | Fahmie | 312/258 |

FOREIGN PATENT DOCUMENTS

| | | | |
|---|---|---|---|
| 2355989 | 3/1975 | France | 211/132 |

*Primary Examiner*—Victor N. Sakran

[57] ABSTRACT

Basin apparatus for use in a hospital including a wheeled transport and a portable disposable basin. The basin is disposable and made of lightweight material which serves also as insulation. The basin has at least two separately molded sinks and having a flange along a rim of the sinks to seat the sinks on a horizontal upper rim of the wheeled transport. The flange of the sinks is provided with apertures and recesses for holding various shaped containers and hospital utensils. In the preferred embodiment, the wheeled transport includes a frame having a rotatably attached shelf wherein the frame is collapsible for convenient storage. Preferably, the sinks are fabricated of molded styrofoam and are sterilized.

9 Claims, 8 Drawing Figures

Fig. 5
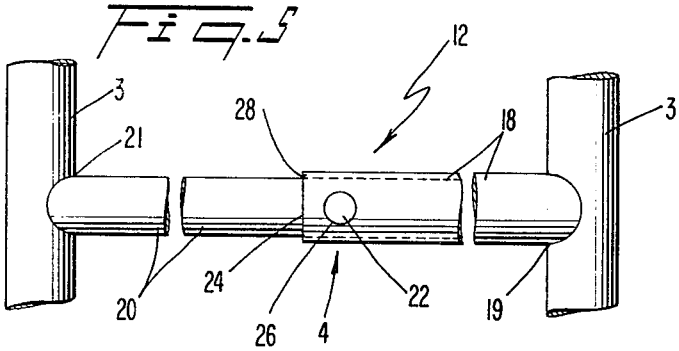
Fig. 8
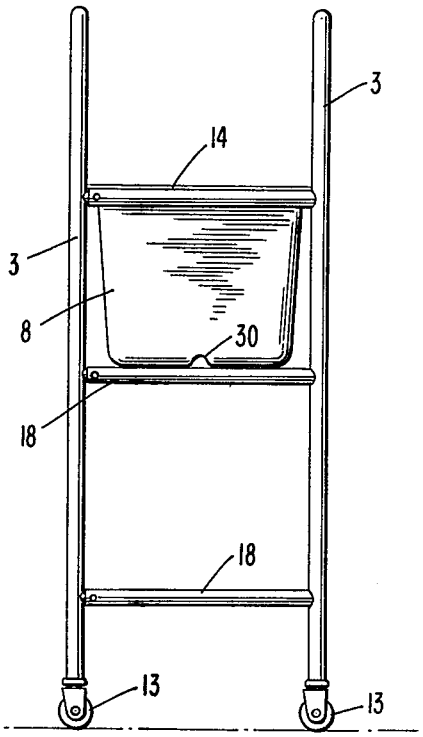
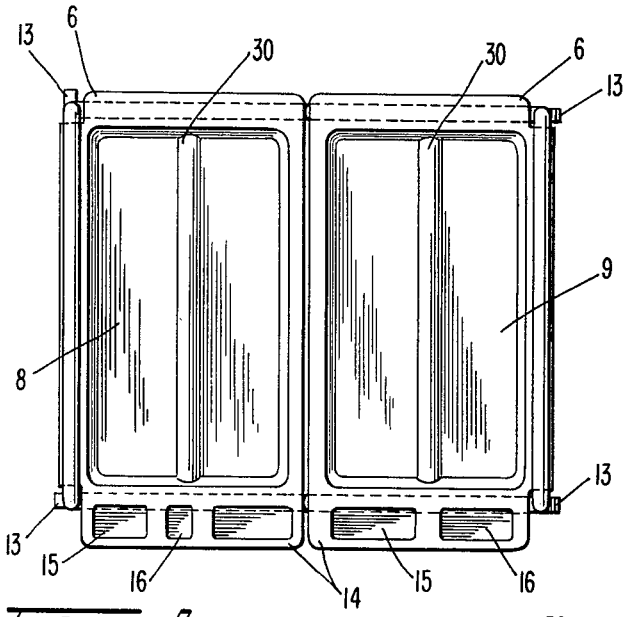
Fig. 6
Fig. 7
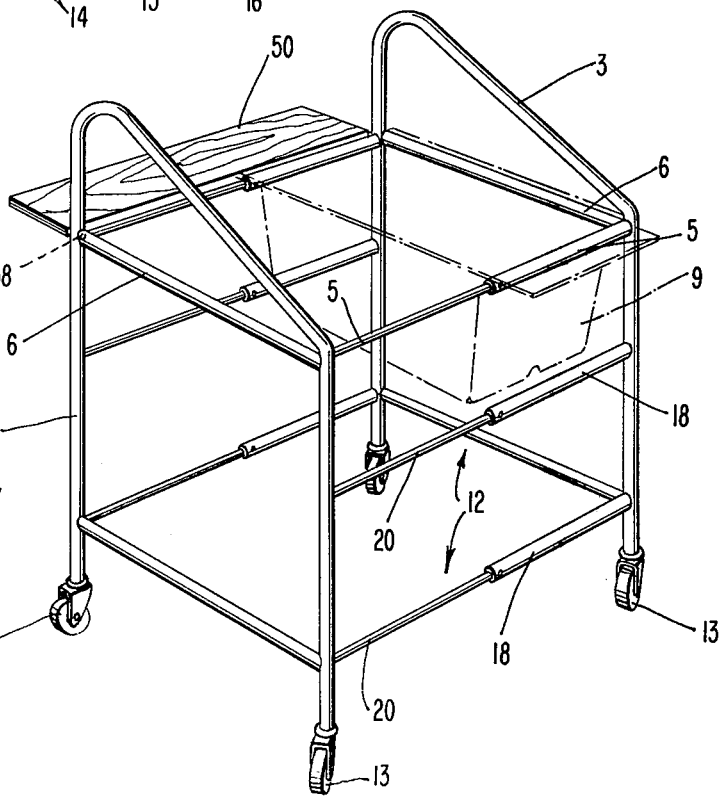

PORTABLE DISPOSABLE BASIN APPARATUS

BACKGROUND OF THE INVENTION

The present invention relates to portable disposable basin apparatus including at least two sinks and a collapsible wheeled transport having particular utility in a hospital.

Many times a day, hospital staff members are required to move basins of liquid throughout the hospital, for example, water for bathing the patient. This may require hand carrying the basin through a long hallway or between floors of a hospital. The travel time in elevators and down hallways between the area in which one would fill the basin and the patient's room, or the location where the basin will be used, may be enough time for the temperature of the liquid to change. For example, heated water for bathing the patient would cool in a short period of time in an uninsulated basin. The situations described herein illustrate typical situations hospital attendants are confronted with daily.

A crisis is a routine event in a hospital and can occur anywhere, in a hallway, or in the patient's room. Should a crisis occur in the hallway, it may mean large and bulky equipment must be moved into the hallway, electrical cords may extend across the hallway, numerous hospital staff members may be crowding in the crisis area or rushing to the crisis. Whether in the hallway or in the patient's room, the crisis situation creates many obstacles to one who must carry a basin filled with a liquid (hot or cold) through the obstructed area to another location in the hospital or to the patient in crisis. If a nurse, for example, must struggle with a full basin in a crisis situation, loss of liquid can result from spilling which can thereby create a dangerous situation.

Day to day care of a patient can require numerous trips by a hospital attendant with basins of liquids. Toting a filled basin can be a physically tiring chore, which can lead to inefficiency. Not only is a filled basin heavy and cumbersome, but it is difficult maintaining liquids at a desired temperature during travel through the hospital.

Not only in a hospital setting is it necessary to transport a basin of liquids but also in emergencies for which an ambulance is required. Treatment in many emergencies outside the hospital often includes cleansing a patient.

Additionally, hospital attendants are daily faced with the problem of storing materials, utensils, and equipment in the crowded conditions of a hospital.

SUMMARY OF THE INVENTION

Accordingly, it is a prime object of this invention to eliminate the above-described problems of providing liquids for bathing and cleansing a patient in a variety of settings.

Another object of this invention is to increase the efficiency in bathing and cleansing a patient who is bedridden, particularly to provide warm bath water and rinse water for the patient when it is required for hospital staff to transport the bath water along corridors and between floors.

Another object of the invention is to make it easier to move a liquid-filled basin through the corridors of a hospital.

A further object of the invention is to provide a disposable basin which can be stored easily and when used can be crushed to a small size and thereby disposed.

This method of disposal conserves space in already crowded hospitals.

Another object of the invention is to provide a disposable basin which is sterilized and thereby eliminates the need to sterilize the basin for each patient's use.

A further object of the invention is to ease the crowded conditions of a hospital by providing a collapsible wheeled transport which can easily be stored.

The objects and advantages of this invention may be realized and obtained by means disclosed herein and particularly pointed out in the appended claims.

To achieve the foregoing objects and in accordance with the purpose of the invention, as embodied and broadly described herein, the basin apparatus for servicing incapacitated persons with materials and utensils at a point remote from the source of the materials and utensils comprises: (1) expendable insulating basin means for separately containing various liquids; and (2) wheeled transport means for removably receiving the basin means.

Preferably, the basin means includes at least two separately molded sinks, a plurality of the sinks being nestable one within another for easy storage. The sinks are preferably molded from styrofoam and sterilized.

Further, in accordance with the objects of the invention, the transport means includes a frame with a horizontal upper rim for seating the sinks and wherein each of the separately molded sinks includes a flange along the top edge for seating the sinks in the frame. Preferably, the flange along the top edge of each sink includes an integral horizontal shelf provided with apertures and recesses for holding patient-oriented supplies and utensils.

Preferably, the frame is collapsible by means of hinges for symmetrical, lateral folding and includes locking means for securing the frame in an operative position.

The present invention provides a lightweight and insulated basin means for seating in a wheeled, collapsible frame. The invention herein disclosed overcomes long-standing problems in hospitals in day to day, as well as crisis, care of patients. The invention further provides an insulated portable basin consisting of at least two sinks which are simple in design, easy to use, and easy to dispose—by crushing, for example.

Flanges located along the upper rim of the molded sinks facilitate easy removal from a frame as well as permitting the storage of many sinks by nesting them. When the hospital attendant must bathe a patient, he or she has only to remove sinks from a nested stack, fill them with necessary solutions and place them in the frame. The portable basin apparatus then can easily be moved from area to area. Once the patient has been bathed, etc., the sinks can be lifted from the frame and discarded or taken home by the patient. For example, a new mother can use the sinks for her own care or for the care of the newborn. Even bedridden patients may be able to utilize the basin for at-home care. Many at-home patients are required to soak parts of the body or cleanse wounds. This care can be given at home with use of the sinks.

Another long-standing problem existing in hospitals is the constant attention paid to sterilizing hospital utensils. Much time and energy is expended sterilizing hospital utensils and supplies. The disclosed invention enables the hospital attendant to use sterilized sinks without any preliminary treatment of them. Because the sinks are disposable, the problem of sterilizing the used sinks is eliminated.

The collapsible frame permits transport of the fluids, provides structure for holding the fluids stably during use, and allows return of the used equipment and fluids for disposal without having to remove the sinks from the frame. The collapsible frame also permits convenient storage of the transport, when not in use.

BRIEF DESCRIPTION OF THE DRAWINGS

The accompanying drawings, which are incorporated in and constitute a part of the specification, illustrate an embodiment of the invention and, together with a description, serve to explain the principles of the invention.

FIG. 5 is a partial side view of the apparatus of FIG. 1 showing the locking means.

FIG. 6 is the overhead view of the apparatus in FIG. 1 showing the separate sinks.

FIG. 7 is a perspective view of the invention showing the frame shelf in operative position and one sink with flange.

FIG. 8 is a front view of the frame shown in FIGS. 1 and 2 in its folded position to accommodate one sink.

DETAILED DESCRIPTION OF THE PREFERRED EMBODIMENT

Figure 1:
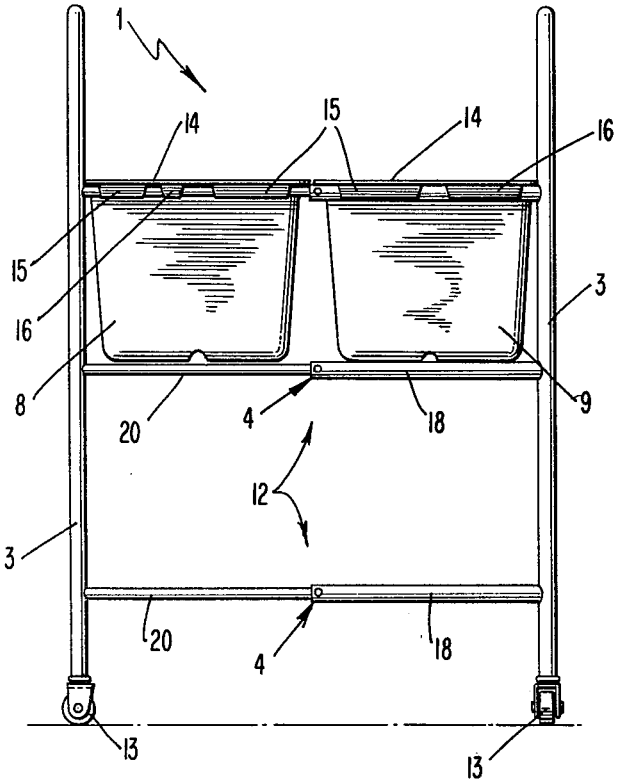
FIG. 1 is a view of the front of the basin apparatus of the invention.

Reference will now be made in detail to the present preferred embodiments of the invention, examples of which are illustrated in the accompanying drawings. In accordance with the invention, the basin apparatus for servicing incapacitated persons with materials and utensils at a point remote from the source of the utensils and materials comprises expendable, insulating basin means for separately containing various liquids; and wheeled transport means for removably receiving the basin means.

As embodied herein and shown in FIGS. 1, 2, 6, 7, and 8, the expendable, insulating basin means includes one or two separately molded sinks 8 and 9. Sinks 8 and 9 are preferably molded from styrofoam which is lightweight, disposable, and heat-insulating for efficient use in servicing a bedridden person. A desirable goal in any hospital is to ease the physical labor of hospital attendants. Lifting and toting cumbersome and heavy objects is part of hospital work, but minimizing physical labor frees more time of hospital attendants for direct patient care. Styrofoam is heat-insulating thereby keeping water or other liquid at a desired temperature. Styrofoam is also crushable so that after sinks 8 and 9 are used, they can be easily discarded by crushing, thus eliminating the need to sterilize for reuse.

In a preferred embodiment of the basin apparatus shown in FIG. 6, each of sinks 8 and 9 is provided with a groove 30 molded into the bottom to give strength to sinks 8 and 9.

A plurality of sinks 8 and 9 can be nestably stacked one within another for easy storage. Sinks 8 and 9 used together in the hospital, for example, enable one to provide, simultaneously, soapy bath water and rinse water. In so doing, the hospital attendant only makes one trip to bathe a patient. Sinks 8 and 9 can be used not only for bathing a patient but also for other cleansing procedures. Because sinks 8 and 9 are nestable, they can be stacked ready for use thereby easing cramped conditions in a hospital. Sinks 8 and 9 can be molded into various sizes and shapes.

Transport means includes a frame 1 with horizontal upper rim 5 for seating molded sinks 8 and 9 and wherein each molded sink 8 and 9 includes a flange 6 along the top edge for seating the sink on frame 1. Sinks 8 and 9 can easily be seated on or lifted from frame 1 because of flange 6 so that replacing used sinks is accomplished conveniently by a hospital attendant.

Figure 4:
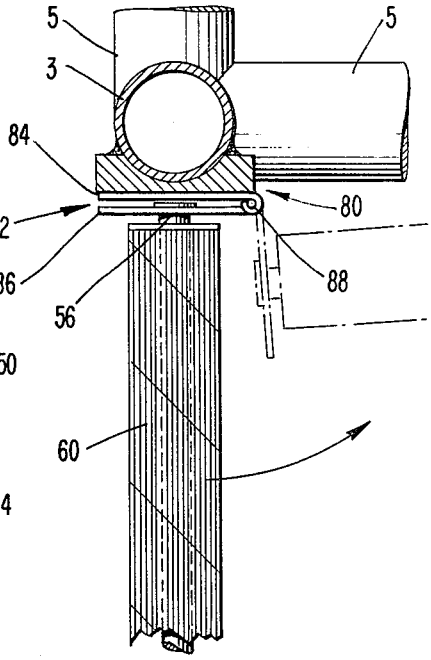
FIG. 4 is the overhead view of shelf and rotational mounting of frame shown in FIG. 3.

Preferably, flange 6 includes an integral horizontal shelf 14 for holding various patient-oriented supplies and utensils. Shelf 14 formed in both sinks 8 and 9 is shown in FIG. 4 with apertures 15 and recesses 16 to accommodate utensils and supplies for bathing and cleansing a patient, for example, oils, powders, cakes of soap, etc. Although apertures 15 and recesses 16 are shown as rectangular in shape, these features of shelf 14 can be formed in any size and shape to accommodate the containers or materials necessary for bathing and cleansing a patient. Shelf 14 can be molded with various dimensions for convenient use.

Figure 2:
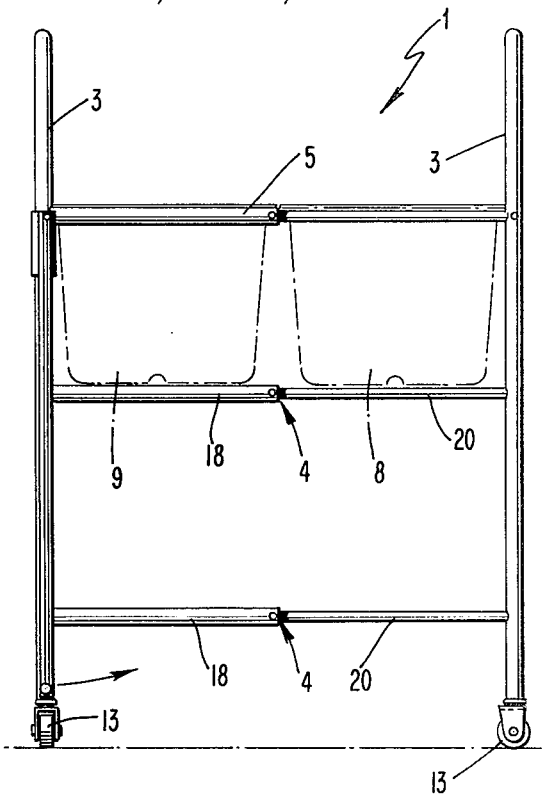
FIG. 2 is the back view of the apparatus in FIG. 1.

The wheeled transport means comprises collapsible frame 1 having horizontal upper rims 5 for seating sinks 8 and 9 and locking means for securing frame 1 in an operative position. As shown in FIGS. 1, 2, 5, and 7, frame 1 is provided with a plurality of rungs 12 connecting legs 3. As embodied herein, locking means is located in rungs 12 and rim 5 as described below. Referring to FIGS. 2, 5, and 7 rung 12 like rim 5, comprises tube 18 and tube 20, both tubes being of equal length, tube 18 being of a larger diameter than tube 20 and having an end for receiving an end of tube 20. Outer ends 19 and 21 of tubes 18 and 20, respectively, are permanently attached to legs 3. Means 4 for locking tube 20 in tube 18 so that frame 1 can be secured in an operative position, is provided by a spring set pin 22 located in locking end 24 of tube 20 and an aperture 26 formed in locking end 28 of tube 18 for receiving pin 22. Folding frame 1 can be accomplished by pressing pin 22 inwardly so that tube 20 slides further into tube 18. As tube 20 moves into tube 18, legs 3 on two opposite sides of frame 1 move laterally towards each other. Frame 1 is completely folded when locking end 24 of tube 20 abuts leg 3 where outer end 19 of tube 18 is attached and when locking end 28 of tube 18 abuts leg 3 where outer end 21 of tube 20 is attached to leg 3. In this way, frame 1 can be stored easily in its collapsed form. In its operative or collapsed position, frame 1 can be moved by use of wheels 13. The same structural details and operation would apply to each of a plurality of rungs 12.

Referring to FIG. 8, when frame 1 is in a fully folded or collapsed position as rungs 12 are shortened by sliding tube 20 into tube 18, it can receive one said sink 8 or 9. Thus, if a hospital attendant can attend to a patient by using only one sink in a particular situation, the hospital attendant can use frame 1 in its folded position and seat one sink 8 or 9 on rim 5. The smaller frame size makes it easier for a hospital attendant to negotiate frame 1 around the hospital.

Preferably, frame 1 can be hinged for symmetrical, lateral folding. Using conventional hinging apparatus, one can provide locking means for collapsible frame 1. Frame 1 can also be made of various kinds of material, for example, plexiglas.

Figure 3:
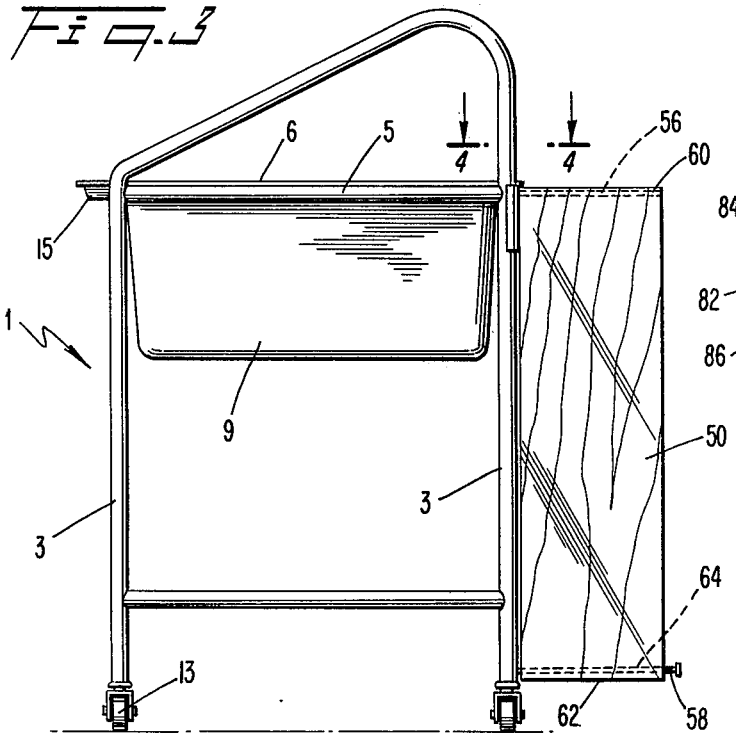
FIG. 3 is the side view of the apparatus in FIG. 1.

As shown in FIGS. 3 and 7, transport means includes frame 1 having a movable shelf 50 which in an operative position is supported on said upper rim 5 of frame 1 by two rods 56 and 58. Shelf 50 is rotatably attached at end 60 to first rod 56 extending outwardly from the side of rim 5 wherein shelf 50 is rotatably attached at one side of rim 5 so that shelf 50 can hang in a vertical position from first rod 56. Shelf 50 is further provided with tube 62 and second rod 58 slidably retained in tube 62 at opposite end 64 of shelf 50. Second rod 58 is inserted into aperture 58 in rim 5 for seating shelf 50 in an operative position. Shelf 50 can be rotated around first rod 56 so that shelf 50 can hang in a vertical position from first rod 56. In an operative position, shelf 50 is supported by rods 56 and 58 and can be used while bathing or cleansing a patient. Although not shown in the drawings, apertures can be provided in shelf 50 for holding utensils and supplies, for example, powders, oils, cakes of soap, etc.

Preferably, the basin apparatus comprises frame 1 wherein first rod 56 has a rotational mounting 80 such that when shelf 50 is in a vertical position first rod 56 can be rotated in mounting 80 in order that shelf 50 can hang flush with frame 1.

Referring to a preferred embodiment shown in FIG. 4, frame 1 includes rotational mounting 80 comprising hinge 82 having two plates 84 and 86 rotatably interconnected by pin 88. A first plate 84 is attached to frame 1 so that said pin 88 is vertically disposed. A second plate 86 has attached perpendicular thereto first rod 56 upon which shelf 50 is rotatably attached such that when second plate 86 is rotated so as to be perpendicular to first plate 84, shelf 50 hangs in a vertical position flush with frame 1 for easy storage. As shown in FIG. 4, first plate 84 and second plate 86 are parallel to each other when hinge 82 is in the closed position. To rotate shelf 50 so that it is hanging flush with frame 1, hinge 82 is opened so that first plate 84 is perpendicular with second plate 86 as shown in FIG. 4. Particularly when shelf 50 is flush with frame 1, frame 1 can be stored conveniently.

Shelf 50 of frame 1 is provided as an alternative to shelf 14 molded in sinks 8 and 9 for holding utensils and supplies needed to cleanse and to bathe a patient. But both can be used together as shown in FIG. 7.

It is apparent from the disclosed invention that the job of hospital attendants caring for numerous patients everyday can be made easier and accomplished more efficiently by practicing the disclosed invention.

It will be apparent to those skilled in the art that further modifications or variations could be made of the disclosed basin apparatus including the basin means and wheeled transport means without departing from the scope or the spirit of the invention. Thus, it is intended that the present invention cover the modifications and variations of this invention provided they come within the scope of the appended claims and their equivalents.

I claim:

1. A portable basin apparatus for servicing incapacitated persons with materials and utensils at a place remote from the source of said materials and utensils, comprising:

a. an expendable basin including an integral flange horizontally extending from said basin at the top edge thereof for removebly supporting said basin in a frame, said basin being molded of a substantially rigid, insulating material in a form permitting the nesting of a plurality of said basins for storage; and b. a wheeled, collapsible frame for supporting said basin, said frame comprising:

1. a pair of one-piece, tubular, vertically disposed side supports each having a front leg and a back leg, said legs being joined at the top thereof in a substantially U-shape;
2. a wheel mounted on the end of each said leg;
3. horizontally disposed, rigid braces secured to and interconnecting the front and back legs of each said side support, one said rigid brace being proximate said wheels of each said side support and one said rigid brace being proximate the top of each said side support;
4. horizontally disposed, telescopically collapsible braces secured to and interconnecting the front legs of said side supports, and the back legs of said side supports, front and back collapsible braces being substantially in the same plane proximate said wheels and front and back collapsible braces being substantially in the same plane proximate the top of said side supports forming a rim for supporting said basin; and
5. releasable lock means attached to each said telescopically collapsible brace for securing each said brace in an extended position to form said frame for receiving said basin and for permitting collapse of said frame for storage after disposal of said basin.

2. Basin apparatus according to claim 1 wherein said frame supports at least two separate basins.

3. Basin apparatus according to claim 1 wherein the flange of said basin includes an integral horizontal shelf having apertures and recesses for holding patient-oriented supplies and utensils.

4. Basin apparatus according to claim 1 wherein said basin is sterilized.

5. Basin apparatus according to claim 1 wherein each said basin includes a groove molded into the bottom for reinforcement.

6. Basin apparatus according to claim 3, 4, 5 or 1 wherein said basin is molded of styrofoam.

7. The basin apparatus as in claim 1 wherein said frame also includes a movable shelf, said shelf comprising a rectangular panel; a first rod extending outwardly from and rotatably and pivotally secured to one leg of one said side support proximate said top braces, said first rod being secured in a transverse tubular opening proximate one end of said panel for movably supporting said shelf in a horizontally disposed operative position and in a vertically disposed storage position; and a second rod movably disposed in a transverse tubular opening proximate the other end of said panel, said second rod being selectively movable in a longitudinal direction for engaging in an opening in the other said side support to releasably secure said shelf in a horizontally disposed operative position proximate said rim supporting said basin.

8. Basin apparatus according to claim 7 also including hinge means for rotationally mounting said first rod to said frame for permitting rotation of said shelf in the vertical position to a position flush with said frame.

9. Basin apparatus as in claim 8 wherein said hinge means comprises a hinge having two plates interconnected for rotation by a pin, one of said plates being mounted on said frame proximate the upper rim such that the other plate rotates about the pin in a horizontal plane, said first rod being secured to said other plate permitting the vertically hung shelf to be rotated to a position flush with the frame.

* * * * *